US010808409B2

(12) United States Patent
Holland

(10) Patent No.: US 10,808,409 B2
(45) Date of Patent: Oct. 20, 2020

(54) GRAB RAIL WITH AUTOMATICALLY ACTIVATED LIGHT

(71) Applicant: Evekare Pty Ltd, Sydney NSW (AU)

(72) Inventor: Glenn Holland, Botany (AU)

(73) Assignee: Evekare Pty Ltd, Sydney NSW (AU)

( * ) Notice: Subject to any disclaimer, the term of this patent is extended or adjusted under 35 U.S.C. 154(b) by 0 days.

(21) Appl. No.: 16/245,281

(22) Filed: Jan. 11, 2019

(65) Prior Publication Data

US 2020/0102753 A1 Apr. 2, 2020

(30) Foreign Application Priority Data

Sep. 28, 2018 (AU) ..... 2018903683

(51) Int. Cl.

| | |
|---|---|
| ***E04F 11/18*** | (2006.01) |
| ***F21S 4/20*** | (2016.01) |
| ***A47K 3/00*** | (2006.01) |
| ***F21V 23/04*** | (2006.01) |

(52) U.S. Cl.

CPC ..... *E04F 11/1802* (2013.01); *F21S 4/20* (2016.01); *A47K 3/003* (2013.01); *E04F 2011/1872* (2013.01); *F21V 23/0442* (2013.01)

(58) Field of Classification Search

CPC ..... E04F 11/1802; F21S 4/20

USPC ..... 4/576.1

See application file for complete search history.

(56) References Cited

U.S. PATENT DOCUMENTS

| | | | | |
|---|---|---|---|---|
| 5,450,299 | A | 9/1995 | Lepre | |
| 6,415,732 | B1 | 7/2002 | Delorenzo | |
| 6,672,552 | B1 | 1/2004 | Jao | |
| 7,722,207 | B2 * | 5/2010 | Bennette | F21V 21/002 359/591 |
| 2008/0007418 | A1 | 1/2008 | Maki et al. | |
| 2008/0080173 | A1 * | 4/2008 | Trimble | E04F 11/18 362/146 |
| 2008/0184475 | A1 | 8/2008 | Sladick et al. | |
| 2010/0315023 | A1 | 12/2010 | Pesson et al. | |
| 2013/0058074 | A1 | 3/2013 | Somei et al. | |
| 2015/0063900 | A1 * | 3/2015 | Stafford | A47K 3/001 403/201 |
| 2016/0025271 | A1 | 1/2016 | Linge | |
| 2017/0022717 | A1 | 1/2017 | Amendolea | |

FOREIGN PATENT DOCUMENTS

| | | | |
|---|---|---|---|
| CN | 204345490 | U | 5/2015 |
| CN | 207122836 | U | 3/2018 |
| DE | 20218114 | U1 | 4/2003 |
| EP | 2565531 | A1 | 3/2013 |

* cited by examiner

*Primary Examiner* — Christine J Skubinna

(74) *Attorney, Agent, or Firm* — The Webb Law Firm

(57) ABSTRACT

A grab rail with automatically activated light including: a straight longitudinal bar having a front longitudinal face and a rear longitudinal face and hollow openings at each end; two light units, each sealingly but releasably secured in one of said hollow end openings; a battery source connected with the light units and located inside the bar; at least one noise activated switching device operatively associated with said LED light units and battery source; and at least one post mount with flange, wherein an end of the post distal the flange is secured to the rear longitudinal face of the bar.

8 Claims, 3 Drawing Sheets

GRAB RAIL WITH AUTOMATICALLY ACTIVATED LIGHT

CROSS-REFERENCE TO RELATED APPLICATION

This application claims priority to Australian Patent Application No. 2018903683 filed Sep. 28, 2018, the disclosure of which is hereby incorporated in its entirety by reference.

FIELD OF THE INVENTION

The present invention relates to hand rails used for physical support that are typically referred to as "or "grab rails" or "grab bars".

The invention has been developed primarily for retrofitting applications in bathrooms and other rooms in domestic residences and hotel and institutional accommodation facilities. However, it will be appreciated that the invention need not be limited to such applications.

BACKGROUND OF THE INVENTION

Any discussion of the prior art throughout the specification should in no way be considered as an admission that such prior art is widely known or forms part of common general knowledge in the field.

Grab rails in the form of simple wall mounted rails have been used extensively in homes, care facilities, hotels and hospitals and the like, to provide a means of support for those that may be unsteady or infirm, especially in bathroom areas. These simple rails work well during daylight or in brightly illuminated areas, as a user will have consciously or subconsciously observed the rail, and if needed suddenly, instinctive reactions and good lighting will assist them in finding the bar to get support.

However, when using facilities such as bathrooms during the night, when the main lighting is usually switched off, there is not the same degree of observation. For example, if the illumination is a simple permanent low wattage night light, all features within the room will have less prominence than during the day. Similarly, if the user has to locate a light switch and turn it on when tired and sleepy, the effect is often quite blinding, and again the rail or rails lose prominence in comparison to the rest of the surroundings.

In order to try and address this problem, several solutions have been proposed that aim to illuminate the rail to make it prominent within a room and easy to locate when needed.

A first type consists of a grab rail that is configured to include lighting elements along the length of the rail that are mains powered that need to be connected to a power source and a switching mechanism. Clearly the need for mains power makes these difficult to retrofit into an existing building. There are alternative designs that are battery operated. However, both of these options still require the user to consciously first find the switch in the dark to illuminate the rail.

Other solutions include the use of 'glow in the dark" elements, either built into the rail, or offered as an edging or wrap that can be attached to existing rails. While these products overcome the problems with mains power and switches, most facilities do not get enough daylight to adequately charge the luminescent materials to provide sufficient lighting throughout the night.

Another problem common to most prior art illuminated grab rail solutions is that the assemblies have a lot of join areas between the main rail and transparent lenses for lights, or between the rail and luminous edging or wraps, and/or the rail and the often cumbersome, rail support fixtures. These joins can accumulate dirt and germs and are difficult to clean, and as a result such designs would not pass the strict hygiene requirements for many applications.

Additionally, other lighted grab rail designs require a lot of dismantling and/or dismounting to facilitate repair or service.

It is an object of the present invention to overcome or ameliorate at least one of the disadvantages of the prior art, or to provide a useful alternative.

SUMMARY OF THE INVENTION

According to a first aspect the present invention provides a grab rail including:

a straight longitudinal bar having a front longitudinal face and a rear longitudinal face and hollow openings at each end;

two light units, each sealingly but releasably secured in one of said hollow end openings;

a battery source connected with the light units and located inside the bar;

at least one noise activated switching device operatively associated with said LED light units and battery source; and at least one post mount with flange, wherein an end of the post distal the flange is secured to the rear longitudinal face of the bar.

Preferably each light unit is an LED light unit.

Desirably each light unit also includes a low light sensor operatively associated with the noise activated switching device.

In the preferred form, at least one light unit includes an integrated battery and noise activation switch. Preferably, both light units include an integrated battery and noise activation switch.

In a preferred embodiment, the light output for each light is around 4 to 5 lumens, and in one form is 4.3 lumens.

Desirably, the lights are activated when both of the following conditions are met simultaneously: the mount of light within the install location is 0.06 lx (Lux) or less; and the amount of sound within the install location is around 60 dB (Decibel) or more.

Once activated the lights will remain illuminated, in one embodiment, for 30 seconds and then switch off, but this could be varied according to requirements.

In a particularly preferred form, each light unit includes a battery source, which in the preferred form comprises two Lithium CR1632 cells.

Preferably the bar is tubular.

In one preferred form the light units are sealingly but releasably retained within the tubular bar by use of a suitably sized resilient o ring. Optionally, an intermal sleeve may be attached to the inside of the tube to receive the light fitting and o ring. In one form, a separate end ring may also be provided that aligns with the sleeve and which has an appropriately finished external facing surface.

Desirably two post mounts are provided, each connected to the rear face of the bar at a location longitudinally inset a minimum distance from each rail end, whereby any post mount fasteners extending into the rail will be clear of the light units and associated elements inserted into the bar ends.

BRIEF DESCRIPTION OF THE DRAWINGS

A preferred embodiment(s) of the invention will now be described, by way of example only, with reference to the accompanying drawings(s) in which.

PREFERRED EMBODIMENT OF THE INVENTION

The present invention will now be described with reference to the following examples which should be considered in all respects as illustrative and non-restrictive.

Figure 1:
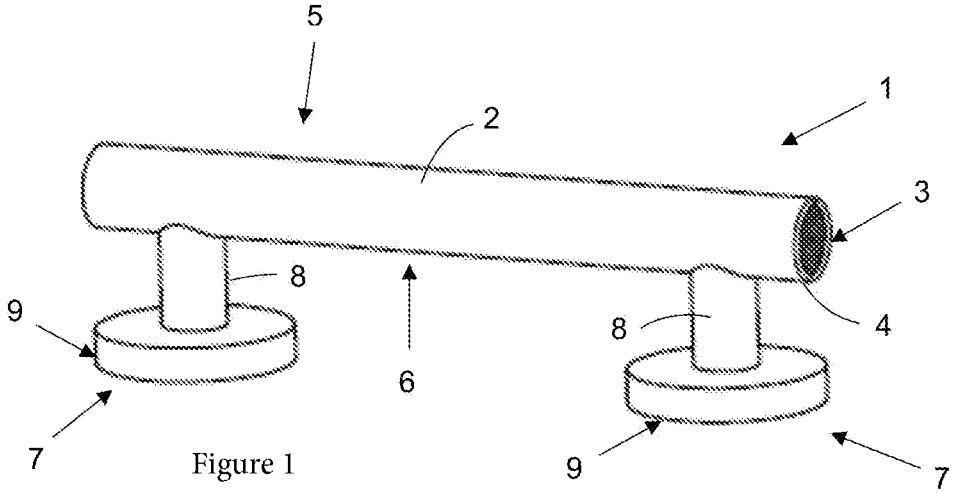
FIG. 1 is a perspective view of a first embodiment grab rail according to the invention.

Referring firstly to FIG. 1 there is shown a first embodiment grab rail 1 according to the invention. The grab rail 1 includes a straight longitudinal tubular bar 2 that has an LED light unit 3 in each hollow end 4. In this preferred embodiment, the light units 3 include an integrated battery source and noise activated switching device.

The bar 2 has a front longitudinal face 5 that in use faces into a room, and a rear longitudinal face 6 which faces a surface to which the grab rail is to be mounted. Connected to the rear face 6 of the rail 2 are two post mounts 7. Each post mount includes a post 8 which connects with the bar 2 and a flange 9 for connection to a wall or other structure (not shown).

Figure 2:
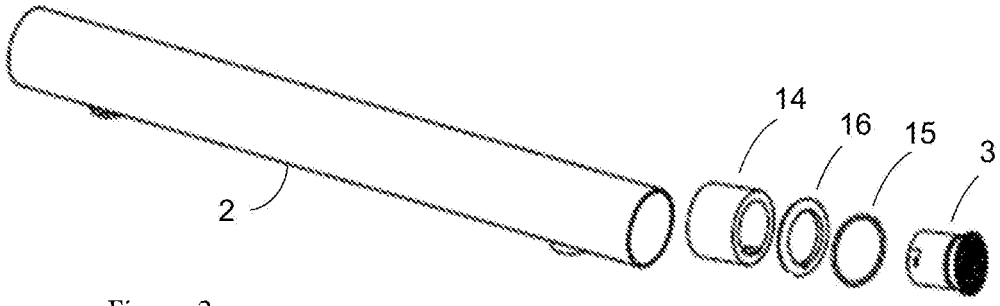
FIG. 2 is an exploded perspective view of the longitudinal bar portion and light fittings of the grab rail of FIG. 1.
Figure 3:
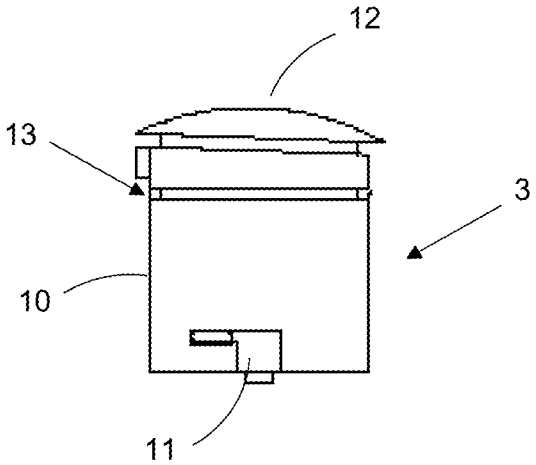
FIG. 3 is an enlarged side view of the light unit shown in the previous figures.
Figure 5:
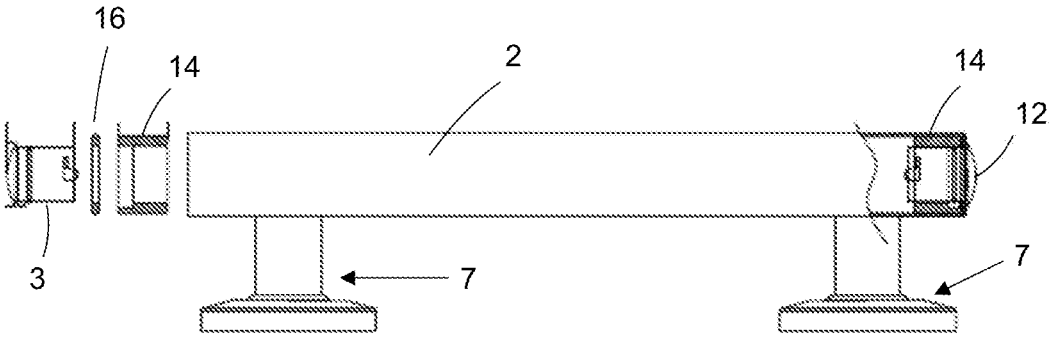
FIG. 5 is a part sectioned and part exploded side view of the assembled grab rail of the previous figures.

Turning next to FIGS. 2, 3 and 5 there is shown a currently preferred arrangement by which the preferred integrated light units are sealingly but releasably secured to the bar 2. The light units 3 each include a housing 10, a switch 11, a lens 12 and an o ring seating groove 13.

Figure 6:
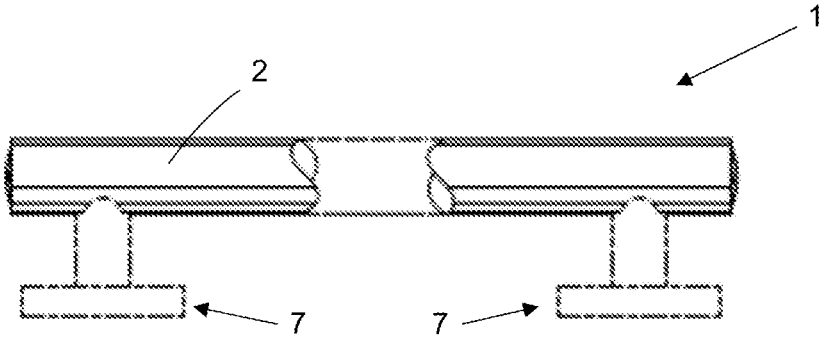
FIG. 6 is a side view of the grab rail of the invention illustrating variable bar length.

In preferred embodiments the bar 2 is a simple metal tube cut to the desired length. As can be seen from FIG. 6, the lighting function of the grab rail is housed within the ends of the bar, which means the bar can easy be made to a large range of standard lengths or custom lengths. The ends of the tube 2 are then prepared to receive and retain the light units by pressing in, or otherwise connecting a sleeve 14. The sleeve 14 has an inner diameter that is larger than outer diameter of the light unit, the clearance selected so that with an appropriately sized 'o' ring 15, captively located on the light unit 3 within the o ring groove 13, the light unit will be sealingly retained within the sleeve by compression of the ring. The sleeve and light unit may also optionally include inter-engaging formations to prevent the unit rotating within the sleeve.

While the sleeve could be configured to extend to the end of the bar 2, in the illustrated embodiment the sleeve is inset from the tube end and a separate end ring 16 is inserted in between the sleeve 14 and lens 12 of the light unit 3.

Figure 4:
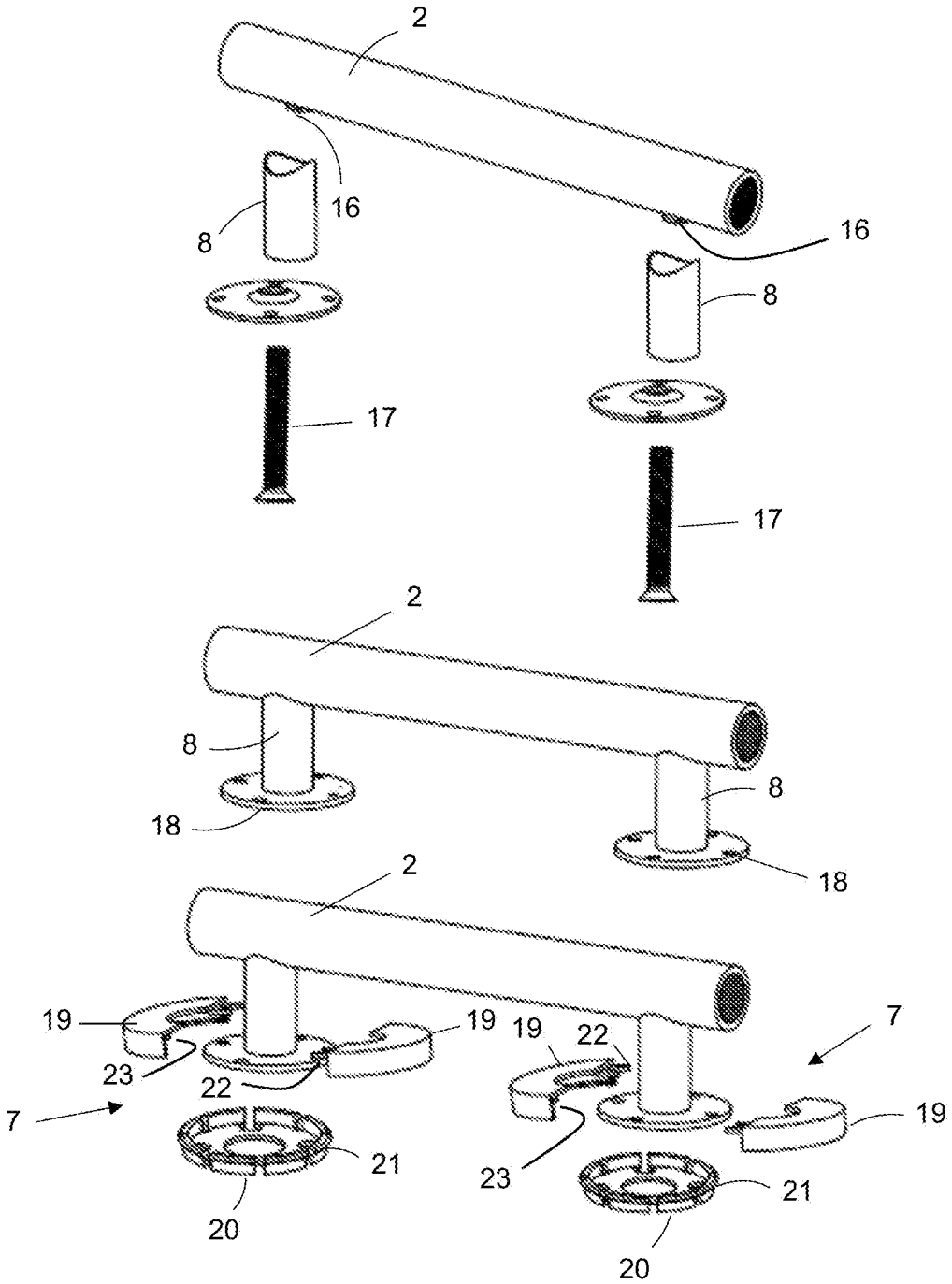
FIG. 4 is a series of exploded views showing attachment of the assembled bar and light fittings of FIG. 2 with the post mount fittings.

FIG. 4 shows a series of exploded perspective views illustrating a preferred form of the post mounts 7 and the means by which they are connected with the bar and light assembly. The posts 8 are also hollow and are cut at one end to mate with the rear face 6 of the bar. Holes are provided in the bar 2 corresponding to the post location centres and threaded sleeves or nuts 16 are welded to the surface 6 around the holes. A threaded fastener 17 is then used with an end plate 18 to secure the three components as shown in the centre view.

While the end plate 7 could function as a mounting flange, the illustrated embodiment includes a two part escutcheon 19 and base plate 20 with retaining edges 21. In use the rail, post and end plate assembly is secured to a support surface on top of the base plate 19 using appropriate fasteners. The fasteners are then hidden from view by bring the two halves of the escutcheon together about the retaining edges 20 of the base plate 19. The escutcheon halves can be connected by any suitable means but in the preferred form illustrated this is achieved by inter-engaging protruberances 22 and apertures 23. These enable the flange covers or escutcheons to be clipped on an off as required.

Clearly other mounting post structures could be used, the main aim of using a post connection being to limit the join area to the rail and maintain clean lines and minimal obstructions when the rail is used.

In one preferred embodiment the integrated light, battery and noise activated switch assembly has the following characteristics:

- Light output: 4.3 Lumens per light (2 lights in each grab rail–Total output=8.6 Lumens
- Power source: CR1632 Lithium Cell (2 Batteries in each light=4 batteries in 1 Grabrail)
- Sensor/Activation: Light is activated when both of the following conditions are met simultaneously: the amount of light within the install location is 0.06 lx (Lux) or less; and the amount of sound within the install location is about 60 dB (Decibel) or more.
- Once activated the lights will remain illuminated for 30 seconds and then switch off.

It will be appreciated that while the particular combination of characteristics have been found to work well for most applications, some or all of these could be varied and still fall within the scope of the invention, provided the end result meets the requirements of providing automatic illumination sufficient to easily identify the rail and provide the required amount of background light, and is automatically triggered by sound levels expected to be created within the target environment.

In the preferred forms, the posts 8 are inset from the bar ends a sufficient distance such that the fasteners 17 cannot foul the light unit 3 or any other functional elements located within the bar 2.

It can be seen that the grab rail of the invention has numerous advantages over the prior art. The use of noise activation, in combination with an ambient light detector, means that when the ambient light is sufficiently low, the simple operation of opening a door for example, can be set to trigger the end lights in the bar to automatically switch on. This provides light to the surrounding area while at the same time highlighting the location of the grab rail should it be needed.

The use of a high efficiency LED light unit, with auto switch off after the timer period has expired, means that the device can function for considerable time periods before the batteries need to be replaced. The units are very easy to retrofit to existing rooms and the simple structure makes tailoring to individual work spaces very easy should this be required. Additionally, replacement of the batteries or light units is very quick and simple and doesn't require any specialist skills. The lens is simply grabbed at the edges and the light unit can be pulled out against the resistance of the o ring seal.

The simplicity of the design also minimises joins, enabling sleek lines that would fit in with current bathroom fitting styling, and which are easy to grab when needed. The minimised joins also enables easy sealing of the joins where needed, limits germ collection points and facilitates easy cleaning, making the grab rails suitable for most applications that have strict hygiene requirements.

While the preferred embodiment uses integrated battery operated low light noise activated LED lights, it will be appreciated that the noise activated switch and battery or batteries could all be independent items, and a single switch used to operate both lights.

Accordingly, while the invention has been described with reference to a preferred embodiment, it will be appreciated that the invention could be embodied in many other forms.

The invention claimed is:

1. A grab rail including:

a straight longitudinal bar having a front longitudinal face and a rear longitudinal face and hollow openings at each end;

two light units, each light unit including a housing, each light unit being releasably secured in a respective hollow opening of said longitudinal bar and retained within the respective hollow opening by a suitably sized resilient O-ring surrounding the light unit housing such that said light units seal each end of said longitudinal bar;

two internal sleeves, each internal sleeve being attached to the inside of the longitudinal bar in a respective hollowing opening to receive a respective light unit housing and O-ring, each internal sleeve surrounding the respective light unit housing and O-ring to releasably secure the respective light unit in the respective hollow opening;

two separate end rings, each separate end ring having a finished external facing surface, each separate end ring being aligned with a respective internal sleeve and surrounding a respective light unit;

a battery source connected with the light units and located inside the bar;

at least one noise activated switching device operatively associated with said light units and battery source; and at least one post mount with flange, wherein an end of the post distal the flange is secured to the rear longitudinal face of the bar.

2. The grab rail according to claim 1, further including a low light sensor whereby the lights will only be activated by the noise activated switching device when the ambient light is below a predetermined level.

3. The grab rail according to claim 1, wherein each light unit is an LED light unit.

4. The grab rail according to claim 1, wherein at least one light unit includes an integrated battery and noise activation switch.

5. The grab rail according to claim 3, wherein both light units include an integrated battery and noise activation switch.

6. The grab rail according to claim 1, wherein the bar is tubular.

7. The grab rail according to claim 1, wherein the at least one post mount with flange comprises two post mounts with flanges, each post mount being connected to the rear face of the bar at a location longitudinally inset a minimum distance from a respective rail end, whereby any post mount fasteners extending into the bar will be clear of the light units and associated elements inserted into the rail ends.

8. The grab rail according to claim 1, wherein the lights are activated when the amount of sound is above a predetermined level and the amount of ambient light is below a predetermined level.

* * * * *